362818 0586 -00 03-30-82 28702 02-23-82 225548 78147.0 04322282 1726

United States Patent [19]

Jemec

[11] 4,322,282

[45] Mar. 30, 1982

[54] TANK FOR AN ELECTROLYTIC CELL

[75] Inventor: Raoul Jemec, Zollikerberg, Switzerland

[73] Assignee: Swiss Aluminium Ltd., Chippis, Switzerland

[21] Appl. No.: 195,250

[22] Filed: Oct. 8, 1980

[30] Foreign Application Priority Data

Oct. 17, 1979 [CH] Switzerland ..... 9324/79

[51] Int. Cl.³ ..... C25C 3/10

[52] U.S. Cl. ..... 204/243 R; 204/67

[58] Field of Search ..... 204/67, 243 R, 244–247

[56] References Cited

U.S. PATENT DOCUMENTS

| | | | |
|---|---|---|---|
| 3,421,995 | 1/1969 | Morel et al. | 204/243 R |
| 3,582,483 | 6/1971 | Sem | 204/243 R X |
| 4,087,345 | 5/1978 | Sandvik et al. | 204/243 R |
| 4,093,524 | 6/1978 | Payne | 204/243 R |

FOREIGN PATENT DOCUMENTS

| | | | |
|---|---|---|---|
| 236551 | 7/1959 | Australia | 204/243 R |
| 555170 | 5/1977 | U.S.S.R. | 204/243 R |
| 576355 | 10/1977 | U.S.S.R. | 204/243 R |

*Primary Examiner*—Delbert E. Gantz
*Assistant Examiner*—Donald R. Valentine
*Attorney, Agent, or Firm*—Bachman and LaPointe

[57] ABSTRACT

During its continuous use, the carbon lining on cells used in the electrolysis of aluminum oxide frequently exhibits cracks which are formed by stresses due to the thermal dilation of the contents of the cell. The present invention prevents the formation of cracks by providing in the floor and corner regions of the tank grooves (protrusions, doming, bulging) which can be deformed elastically so as to yield to the pressure caused by the dilation until the forces on the cell walls are equalized. Also provided are horizontal, movable hollow sections, secured to the sidewalls of the metal tank. The sections bend as a result of the temperature gradient across them such that they counter the pressure on the sidewalls due to the dilation of the cell contents. This effect can be amplified by providing holes in the walls of the hollow section so as to reduce thermal conduction within the sections and thereby maintain the temperature gradient therein. The effect can be amplified by making the hollow sections out of two materials having different thermal expansion coefficients.

15 Claims, 4 Drawing Figures

TANK FOR AN ELECTROLYTIC CELL

BACKGROUND OF THE INVENTION

The present invention relates to a tank for an electrolytic cell, in particular a tank used in cells for the production of aluminum by fused salt electrolysis having a sidewall lining made essentially of carbon or the like and cathode blocks wherein a compressed mass is embedded between the wall lining and the cathode blocks, and reinforcing elements are provided around the sidewalls of the tank.

The large scale production of aluminum by the Hall-Heroult process by the electrolysis of aluminum oxide, is carried out in various types of electrolytic cells which differ mainly in the construction of their electrodes. Common to most cell constructions is a metal tank, the sidewalls of which are lined with carbon blocks of various shapes, and in which tank cathode blocks which participate in the electrolytic process are provided at the bottom.

As the electrolytic process is carried out at a temperature of around 1000° C., the cathode expands considerably. The carbon blocks at their edge follow this thermal expansion which leads to gaps between the tank and the carbon blocks at said edge, and to cracks in the material in these carbon blocks. Aluminum then enters the gaps via these cracks leading to more frequent repairs, premature failure and therefore reduced service life of the carbon cathodes and/or the tank.

It has also been found that on starting up the cell, the normally present compressed mass between the carbon blocks at the edge and the cathode blocks, shrinks and produces further cracks.

In order to overcome these disadvantages attempts have been made to counter the expansion of the tank by providing simple, mechanical reinforcing. For example, various metal strips or sections have been mounted at the sidewalls of the tank. In practice, however, it has been found that such reinforcing of the tank walls does not, as a rule, have any significant, limiting effect on the formation of the described cracks.

The reinforcing strips either reach much the same temperature as the tank and expand accordingly, or they brace the tank rigidly and the tank expands very markedly at the places which are not reinforced.

It is therefore the principal object of the present invention to shape or reinforce the tank of an electrolytic cell in such a manner that these disadvantages are not experienced and in particular such that elastic expansion of the tank is maintained without causing damage to the lining materials.

SUMMARY OF THE INVENTION

The foregoing object is achieved by way of the present invention wherein the tank of an electrolytic cell is reinforced at its sidewalls by stiffening elements which maintain within elastic limits the thermal expansion of the tank, the said elements being moveable by means of appropriate facilities.

The stiffening elements, referred to in the following are thermo-springs, are preferably in the form of hollow sections the side of which in contact with the tank heats up with the tank while the side away from the tank is 100°-200° C. cooler.

To further improve the effectiveness of the hollow sections openings are provided on their long sides which reduce the flow of heat from the inside to the outside of the thermo-springs. The circulation of air which results helps further to achieve and maintain the temperature difference.

This temperature difference in the hollow sections leads to a differential in lengthwise dilation when thermal equilibrium is reached with the electrolytic cell. This differential in elongation causes the whole section to bend inwards towards the side in contact with the tank wall.

The bending can be increased further by making the section halves out of two different materials with different coefficients of expansion to form a kind of bimetallic strip such that the inner side of the section next to the tank has a higher expansion coefficient and the outer side the lower coefficient of expansion. As the hollow section is anchored by virtue of its shape onto the sidewall of the tank, the sidewall takes on the bending produced by the section so that the interior of the tank is acted on by a force which elastically counters the forces caused by the expanding contents of the cell pressing on the inside of the tank wall. By appropriate adjustment of the thermal equilibrium in the tank and by corresponding dimensioning and choice of material for the hollow section, the opposing forces reach the same level and compensate each other so that deformation of the sidewalls of the tank and the undesireable side effects this produces are minimized or completely eliminated.

In order to achieve the desired elasticity, the thermo-spring is secured to the sidewall by means of an element which permits the tank wall to expand in spite of the thermo-spring fitted there. In addition, the thermo-springs can be held in place by bolts in elongated holes or by sliding rails on the sidewalls.

In another embodiment the reinforcing can be provided by wing-shaped projections which are shaped out of neighboring longitudinal edges of the thermo-spring and engage in a tongue-and-groove manner in sliding rails fitted to the sidewalls of the tank.

This way of mounting the hollow section not only ensures the forces resulting from the heating and bending of the hollow section are transferred to the tank wall, but also enables simple and straightforward mounting and removal of the whole device.

For reasons relating to the stresses formed, the thermosprings are preferably positioned above the cathode bars leading to the cathode blocks.

Another advantage of the present invention is that it prevents the tank wall from doming outwards.

Without thermo-springs the doming of the tank walls is greatest at the middle. The forces due to the dilation of the cathode blocks in the corner regions press the tank outwards. This leads to a situation where the lining near the middle of the sidewall no longer exerts any force whatsoever against the sidewalls.

The thermo-spring counteracts the curving of the sidewalls and thus prevents cracking of the cathode lining by (a) dimensional reinforcing the walls, and (b) acting inwards due to the temperature difference on the sides of the thermo-spring itself as a result of the curvature of the thermo-springs.

To modify and regulate the expansion, preferably one or more expansion rails are also provided in the floor of the tank and are usefully in the form of a wave-like channel. These rails prevent excessive tensile forces developing between the tank walls and the floor.

The expansion rails can, as desired, be positioned on or in the floor, depending on the design of the tank or the construction requirements.

Likewise, the corners are preferably curved outwards and thickened, so that no excessive stresses can be created by the uniform expansion of the walls. In practice it has been found that the most favorable curvature at the corners is such that the ratio of the curvature to the length of the sidewalls of the tank is from 1:3 to 1:10.

BRIEF DESCRIPTION OF THE DRAWINGS

Further advantages, details and features of the present invention are revealed in the following description of the preferred exemplified embodiments and the help of the following drawings

DETAILED DESCRIPTION

Figure 1:
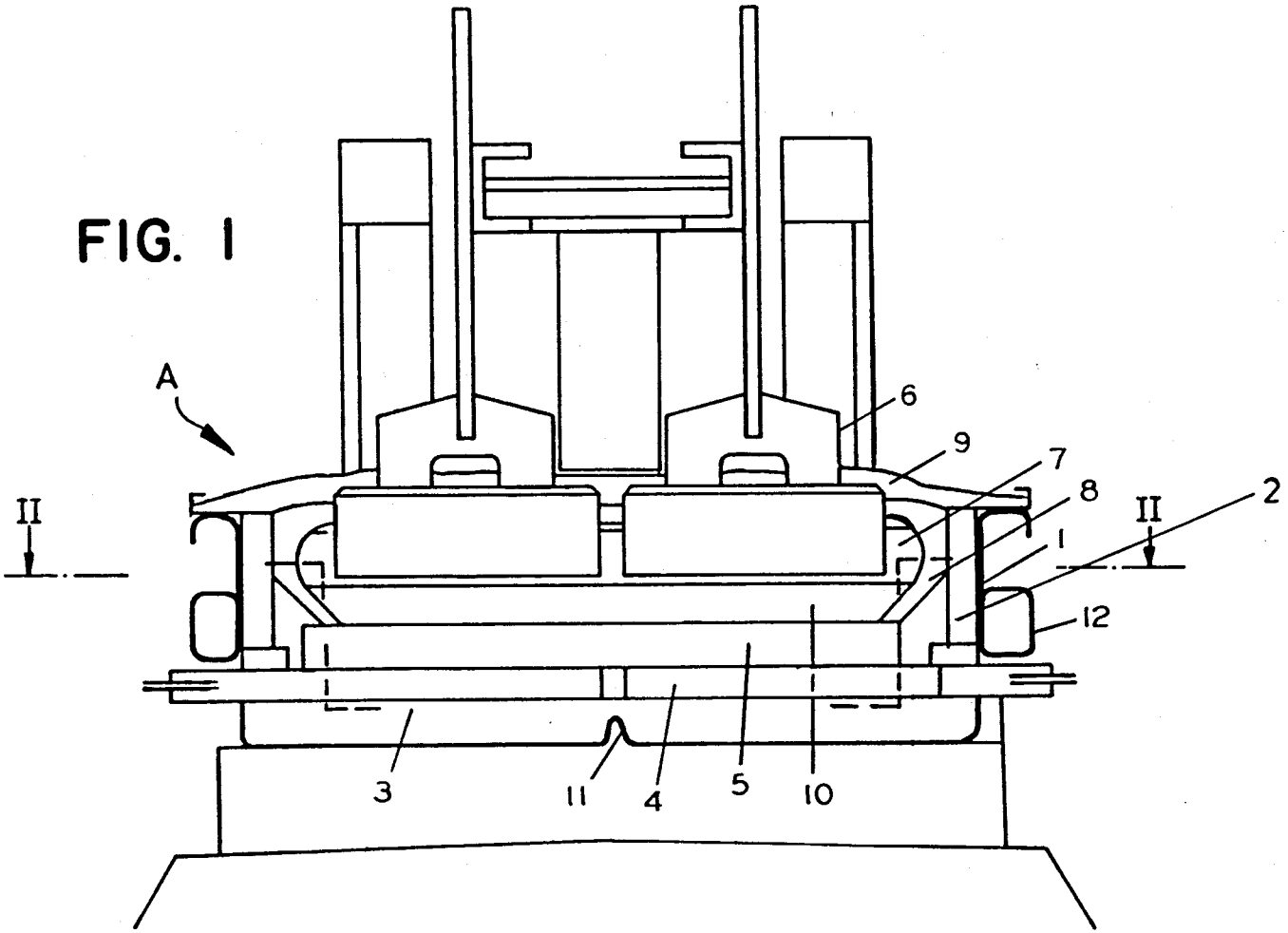
FIG. 1: Is a schematic cross section through an electrolytic cell.

An electrolytic cell A shown in FIG. 1 comprises a metal tank 1 which is rectangular in plan view and is usually made of low carbon steel. The bottom of the tank 1 is lined with insulating material and its sidewalls are lined with carbon blocks 2. Cathode bars 4 which lie on the insulating material 3 pass through the sidewalls of the steel tank 1. Cathode blocks 5 rest on the cathode bars 4. If desired there may be a space between the cathode blocks 5 and the carbon blocks 2 at the edges, with a compressed mass 14 filling this space.

Anodes 6 dip into the electrolyte 7 which is a molten bath of aluminum salts and fluxing agents, the liquid electrolyte being limited at the sides of the tank and upwards by a crust 8 of solidified electrolyte. On top of the crust 8 is alumina 9. Molten aluminum 10 which has been separated out in the process collects between the electrolyte 7 and the cathode blocks 5.

The floor of the tank 1 features one or more expansion rails 11 which in cross section are wave-shaped and, lengthwise, can extend the whole length and/or breadth of the floor of the tank 1.

Figure 2:
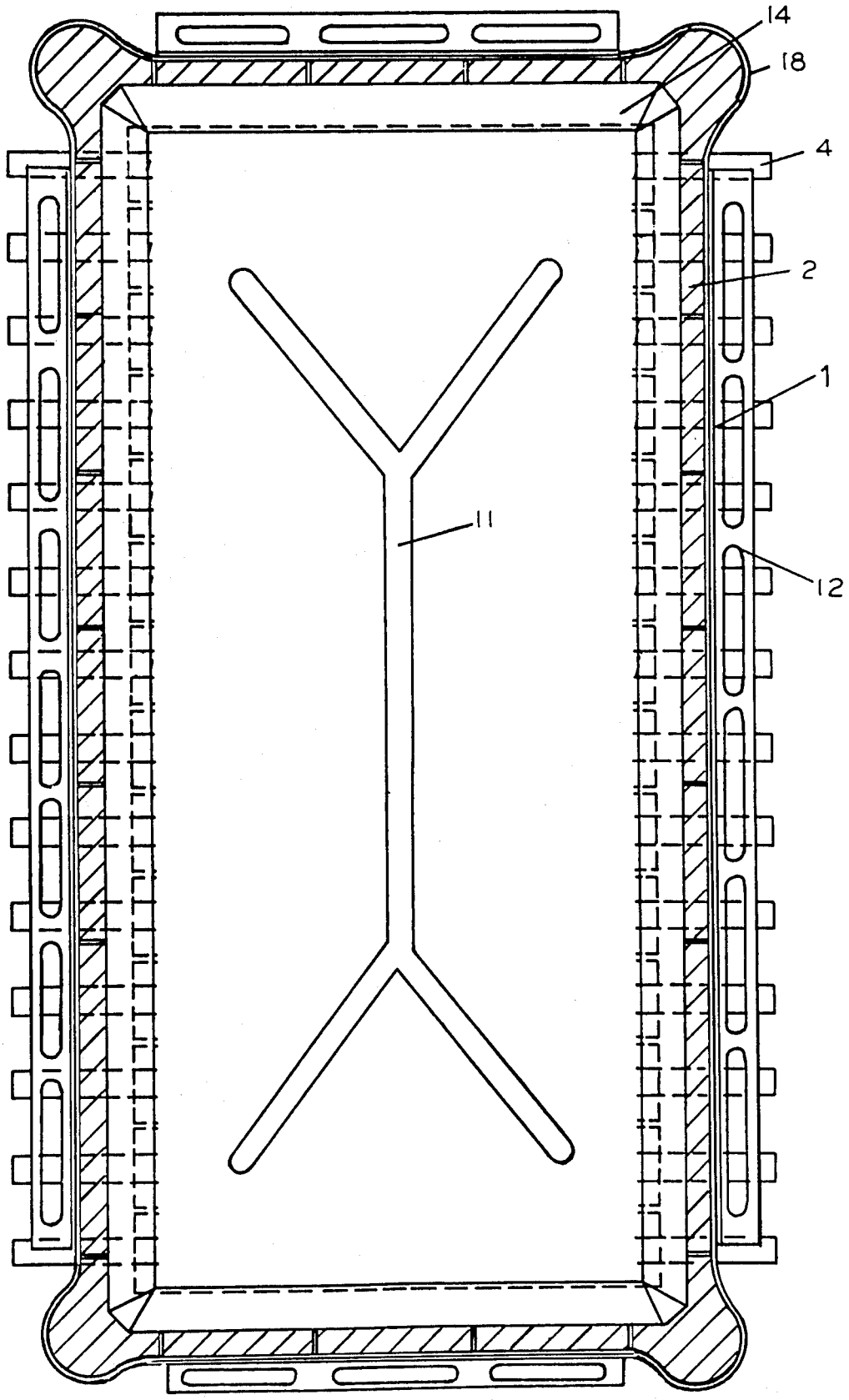
FIG. 2: Is a plan view of the cell shown in FIG. 1 sectioned along line II—II in FIG. 1.

The expansion rails 11 in the floor of the tank can be of various shapes, as seen in plan view, the double Y shape shown in FIG. 2 being simply one example. The choice of shape in each individual case is to be selected with regard to the thermal dilation expected of the contents of the cell or on the basis of constructional criteria.

The corners 18 of the tank 1 are, as shown in FIG. 2, curved outwards and are preferably thicker. In plan view they are the shape of a segment of a circle or curve. It has been found that the useful ratio of the length of curvature of all four curved corners 18 to the length of the sidewalls of the tank is in the range 1:3 to 1:10. If the hot contents of the cell dilate and correspondingly exert outward directed forces on the inside of the walls of the tank 1, then the curvatures at the corners allow elastic deformation there, without any excessive tensile forces being created.

Figure 3:
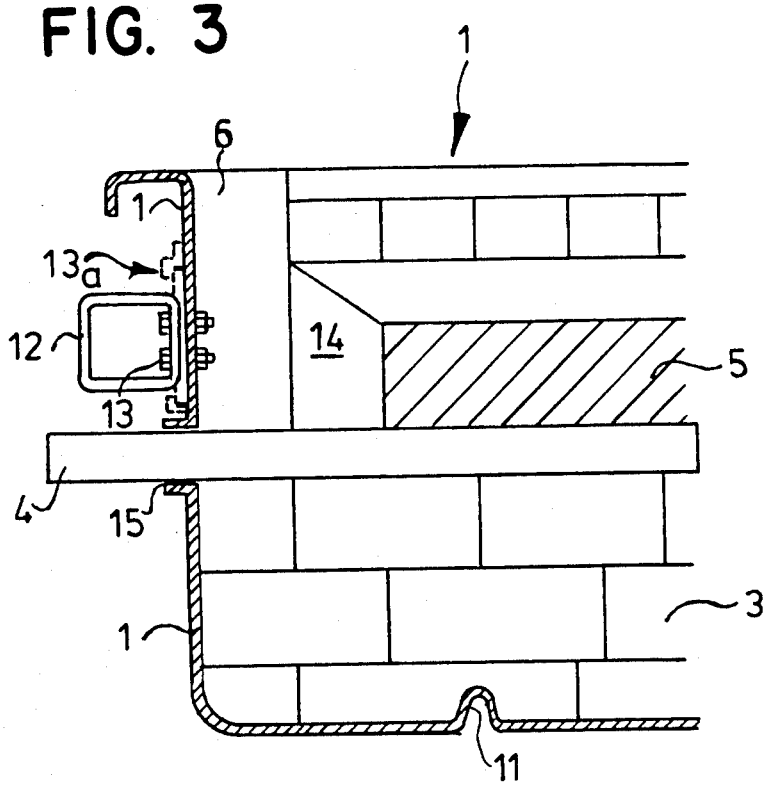
FIG. 3: Is an enlarged detail of a sectioned part of an electrolytic cell.

The sidewalls of the steel tank 1 are surrounded with thermosprings 12 which are mounted onto the tank and are secured to the tank by elements 13 (FIG. 3). The thermo-springs 12 are preferably mounted to the steel tank 1 above the inlet 15 for the cathode bars 4.

Figure 4:
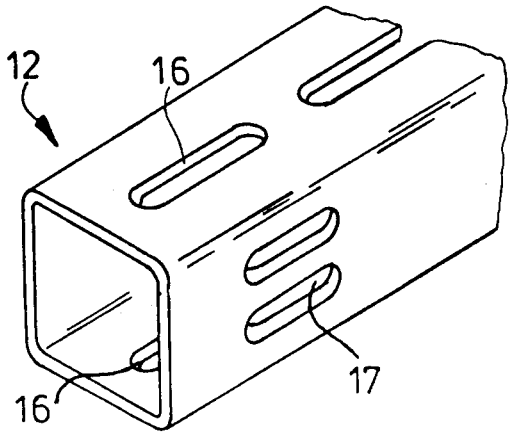
FIG. 4: Is a perspective view of a thermo-spring.

A thermo-spring 12 comprises, as shown in FIG. 4, preferably hollow box-shaped sections having openings in the upper and lower sides. These openings make the circulation of air possible.

The thermo-springs 12 are mounted to the steel tank 1 by means of sliding rails or bolts. In the latter case, the side of the springs 12 facing the tank 1 are provided with slits 17 which enable the securing elements 13 to be moved.

With the sliding rail 13*a* arrangement (FIG. 3) used to mount the springs 12, wing-shaped projections are provided on wo neighboring longitudinal edges of the thermo-springs 12. These projections engage with the sliding rails 13*a* in a tongue-and-groove like manner.

It is to be understood that the invention is not limited to the illustration described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In an electrolytic cell used in the production of aluminum having a tank having a floor provided with cathode blocks and sidewalls provided with essentially a carbon-like lining the improvement which comprises selectively positioned stiffening elements and securing means for releasably securing said selectively positioned stiffening elements to the sidewalls of the tank for reinforcing said sidewalls so as to counter the pressure exerted on said sidewall due to the dilation of the contents of the cell.

2. An electrolytic cell according to claim 1 wherein said stiffening elements are in the form of elongated hollow sections.

3. An electrolytic cell according to claim 2 wherein said sections are provided with a plurality of apertures.

4. An electrolytic cell according to claim 3 wherein said sections are substantially horizontally disposed.

5. An electrolytic cell according to claim 2 wherein said elongated hollow section is formed of two different materials having different coefficients of expansions such that the half of the hollow section closest to said sidewall of said tank is formed of a material having a coefficient of expansion greater than the half of the hollow section farthest from said sidewall.

6. An electrolytic cell according to claim 1 wherein said securing means comprises bolts.

7. An electrolytic cell according to claim 1 wherein said securing means comprises a wing-shaped projection provided on said stiffening elements and sliding rails secured to said sidewalls wherein said projection slides in a tongue-and-groove type manner in said rails.

8. An electrolytic cell according to claim 1 wherein said cell is provided with cathode bars leading to said cathode blocks and said stiffening elements are positioned above said cathode bars.

9. An electrolytic cell according to claim 1 wherein said floor of said tank is provided with a channel-like bulge.

10. An electrolytic cell according to claim 1 wherein the corners of said tank are curved and the thickness of said corners is greater than the thickness of said sidewalls.

11. An electrolytic cell according to claim 10 wherein the ratio of curvature of the length of all four corners to the length of said sidewalls is from about 1:3 to 1:10.

12. An electrolytic cell according to claim 1 wherein said stiffening elements act as thermo-springs.

13. In an electrolytic cell used in the production of aluminum having a tank having a floor provided with cathode blocks and sidewalls provided with essentially a carbon-like lining the improvement which comprises providing said floor of said tank with a channel-like bulge so as to increase the elastic behavior of the cell.

14. An electrolytic cell according to claim 13 wherein the corners of said tank are curved and the thickness of said corners is greater than the thickness of said sidewalls.

15. An electrolytic cell according to claim 14 wherein the ratio of curvature of the length of all four corners to the length of said sidewalls is from about 1:3 to 1:10.

* * * * *